United States Patent [19]

Mertler

[11] Patent Number: 4,627,411

[45] Date of Patent: Dec. 9, 1986

[54] GAS BURNER AND MANIFOLD ASSEMBLY

[76] Inventor: Gary W. Mertler, 7916 N. Congress Park Dr., Dayton, Ohio 45459

[21] Appl. No.: 677,798

[22] Filed: Dec. 4, 1984

[51] Int. Cl.[4] ..... F24C 3/10

[52] U.S. Cl. ..... 126/39 E; 239/558; 126/39 R

[58] Field of Search ..... 285/161; 239/600, 550, 239/567, 558; 126/39 R, 39 E, 39 H, 39 N, 39 K, 39 M, 51, 26; 431/354, 355, 343, 195, 154

[56] References Cited

U.S. PATENT DOCUMENTS

| | | | |
|---|---|---|---|
| 564,681 | 7/1896 | Bryan | 431/354 |
| 2,537,692 | 1/1951 | Mueller | 431/191 X |
| 2,595,005 | 4/1952 | Shelton et al. | 126/39 H |
| 2,646,112 | 7/1953 | Brodbeck | 239/558 X |
| 2,891,608 | 6/1959 | Mueller | 431/194 |
| 3,922,138 | 11/1975 | Biddle et al. | 126/39 R X |

FOREIGN PATENT DOCUMENTS

| | | | |
|---|---|---|---|
| 783565 | 7/1935 | France | 239/558 |
| 259258 | 6/1927 | Italy | 239/558 |
| 066688 | 3/1925 | Sweden | 239/558 |

*Primary Examiner*—Samuel Scott
*Assistant Examiner*—Carl D. Price
*Attorney, Agent, or Firm*—Jacox & Meckstroth

[57] ABSTRACT

A gas supply manifold has upper and lower sheet metal walls defining a gas supply passage extending to an annular chamber defined between concentric openings within the walls. A gas burner unit mounts on the manifold and has concentric inner and outer walls defining an annular chamber which connects with the annular chamber in the manifold. A drawn sheet metal fitting engages a shoulder within the burner unit and includes a downwardly projecting tubular portion having a corrugated cross-sectional wall configuration defining helical candelabra threads. A drawn sheet metal nut has an upper flange portion projecting outwardly from a tubular portion having a corrugated cross-sectional wall configuration defining candelabra threads mating with and engaging the threads on the fitting to secure the burner unit to the manifold.

5 Claims, 3 Drawing Figures

GAS BURNER AND MANIFOLD ASSEMBLY

BACKGROUND OF THE INVENTION

In the construction of a gas burner assembly for a gas range or stove, the gas is commonly supplied to ach burner unit of the range through a manifold constructed of upper and lower sheet metal panels. The panels are coupled together and define gas supply passages extending to annular gas chambers each defined between concentric openings within the upper and lower walls of the manifold. A gas burner unit projects upwardly from each set of concentric openings and includes inner and outer generally cylindrical sheet metal walls defining an annular chamber which connects with the corresponding annular chamber within the manifold. The outer wall is provided with small circumferentially spaced openings through which the gas escapes for ignition by a pilot light or a spark igniter.

The inner wall of each burner unit includes a reduced cylindrical portion projecting downwardly from an annular shoulder within the unit and into the opening within the bottom wall of the manifold. Commonly, each burner unit is secured to the manifold by an aluminum fitting having a flange portion engaging the shoulder and projecting outwardly from a downwardly projecting tubular portion having externally cut fine helical threads. The aluminum fitting has a relatively thick wall thickness so that the fine helical threads may be cut into the fitting without substantially weakening the fitting. The helical cut threads receive a cast metal or aluminum nut having internally tapped or cut fine threads which mate with the cut threads on the tubular fitting.

It is desirable for the attachment fitting and nut to be of substantial diameter with the fitting having an open bottom so that any liquid which accidentally spills into the burner unit will flow downwardly through the burner unit and fitting and into a drip pan below the manifold. The relatively large size of the tubular fitting and cast nut and the substantial metal required to form the fitting and nut result in adding a significant cost to secure each gas burner to the manifold. The fine threads of the fitting and nut sometimes present a problem of cross-threading of the nut onto the fitting, and this results in scrapping the fitting and nut.

SUMMARY OF THE INVENTION

The present invention is directed to an improved gas burner and manifold assembly adapted for use on a gas range and which significantly reduces the cost of attaching or securing each of the gas burner units to the gas supply manifold and provides for quickly attaching each burner unit to the manifold. The assembly of the invention also eliminates the problem of cross-threading the fine threads of the large diameter nut onto the tubular fitting and assures that each burner unit is positively coupled to the manifold.

In accordance with one embodiment of the invention, the above features are provided by coupling or securing each sheet metal burner unit to the sheet metal manifold by a thin sheet metal fitting and a corresponding thin sheet metal nut member. The fitting is produced by drawing a thin sheet of aluminum to form a flange portion projecting outwardly from a tubular portion. The tubular portion has a lower end section with a corrugated wall configuration in axial cross-section, formed by rolling candelabra threads within the lower end section of the fitting. The nut member is also drawn from thin aluminum sheet metal and includes a flange portion projecting outwardly from a tubular portion also having a corrugated wall configuration in axial cross-section, formed by rolling helical candelabra threads on the tubular portion. The nut member may be quickly threaded onto the fitting for securing the burner unit to the manifold.

Other features and advantages of the invention will be apparent from the following description, the accompanying drawing and the appended claims.

DESCRIPTION OF THE PREFERRED EMBODIMENT

Figure 1:
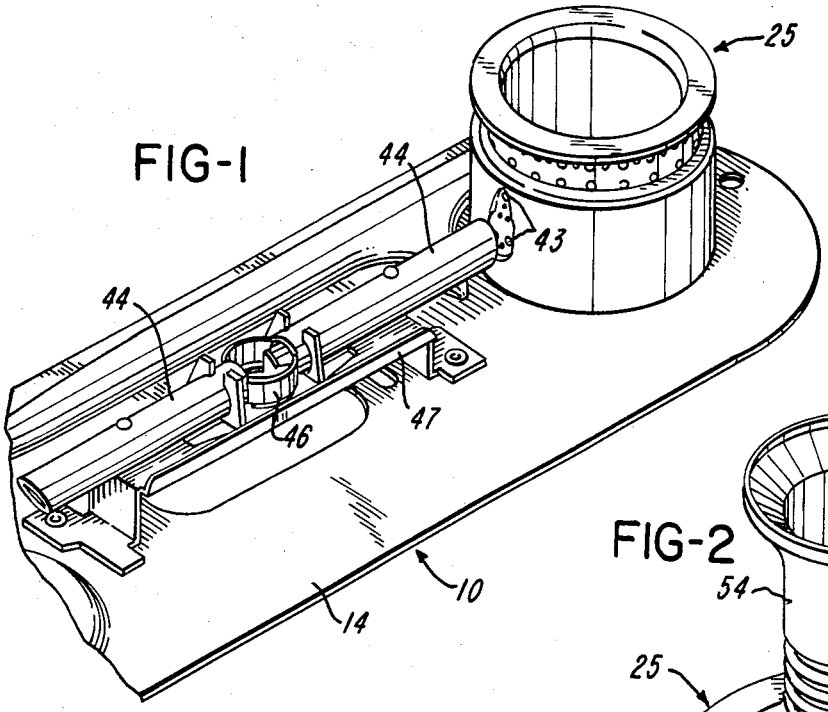
FIG. 1 is a fragmentary perspective view of a gas burner and manifold assembly constructed in accordance with the invention.

FIG. 1 illustrates a section of a gas burner assembly 10 including a manifold 12 formed by an upper sheet metal panel 14 and a lower sheet metal panel 16. The upper panel 14 has an outer peripheral edge portion 17 (FIG. 2) which is hemmed or folded around the outer edge portion of the lower panel 16 so that the upper and lower panels are rigidly coupled together. When connected or coupled together, the upper and lower panels define a gas supply passage 19 (FIG. 2) which extends to an annular chamber 21 (FIG. 3) defined between a cylindrical lip forming a circular opening 22 within the upper wall 14 of the manifold 12 and a smaller cylindrical lip forming a circular opening 24 within the lower wall 16 of the manifold 12.

The sheet metal manifold 12 supports a plurality or set of gas burner units 25, one of which is shown in FIG. 1. Each burner unit 25 includes an outer generally cylindrical sheet metal wall 28 and a generally cylindrical inner sheet metal wall 29, and the walls 28 and 29 define therebetween an annular chamber 31. The upper edge portions of the walls 28 and 29 are secured together by a peripheral hem portion 33, and a series of circumferentially spaced small openings 34 are formed within a groove within the outer wall 28 to define outlet ports for the gas received within the chamber 31.

Figure 3:
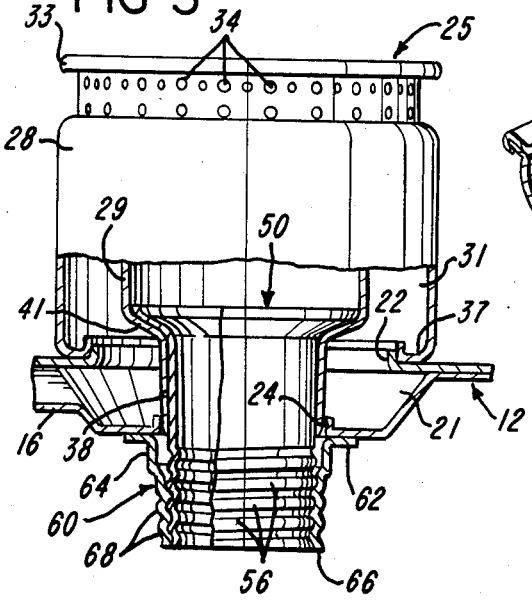
FIG. 3 is a fragmentary axial section of the burner unit and manifold assembly shown in FIG. 1 and with the coupling fitting and nut member shown in part axial section.

As shown in FIG. 3, the outer wall 28 of the burner unit 25 has an inwardly projecting bottom flange portion 37 which seats on the upper wall 14 of the manifold 12 around the lip defining the opening 22. The inner wall 29 of the burner unit includes a reduced cylindrical portion or tubular section 38 which projects downwardly into the smaller lip defining the opening 24 within the bottom wall 16 of the manifold 12. The reduced tubular section 38 forms a tapered internal shoulder 41 in the inner wall 29 of the burner unit and cooperates to form a fluid or gas connection between the chamber 21 within the manifold 12 and the chamber 31 within the burner unit 25.

As also shown in FIG. 1, the outer wall 28 of the burner unit 25 has a group of small openings 43 through which gas may escape and flow horizontally through a pilot tube 44 to a gas igniter within a coupling ring 46.

The gas igniter (not shown) may be a pilot light or an electronic spark igniter as now commonly used. The pilot tube 44 is supported by a hat-shaped sheet metal bracket 47 which mounts on the upper wall 14 of the manifold 12 and also supports another pilot tube 44 extending from another burner unit 25 (not shown).

In accordance with the present invention, each of the burner units 25 is secured to the manifold 12 by an aluminum sheet metal fitting 50 which inlcudes an outwardly projecting annular flange portion 52 terminating with a upwardly projecting annular lip portion 53. The fitting 50 also includes a tubular portion 54 having a lower end section with a corrugated wall configuration in axial cross-section and forming helical candelabra threads 56, as best shown in FIG. 3. As also shown in this FIG. 3, the flange portion 52 of the fitting 50 seats on or engages the shoulder 41 of the inner wall 29 of the burner unit 25, and the tubular portion 54 projects downwardly through the tubular section 38 of the burner unit inner wall 29.

The lower section of the fitting 50 having the helical threads, projects downwardly below the bottom wall 16 of the manifold 12. The sheet metal fitting 50 is drawn in progressive steps from a flat circular aluminum sheet metal disk having a thickness of about 0.020 inch, and the bottom end of the fitting is open. The helical candelabra threads 56 are rolled into the tubular portion 54 as the final operation and have a pitch of about eight threads per inch. Thus the fitting 50 is made in a manner similar to the sheet metal threaded fitting or base on an incandescent light bulb.

Figure 2:
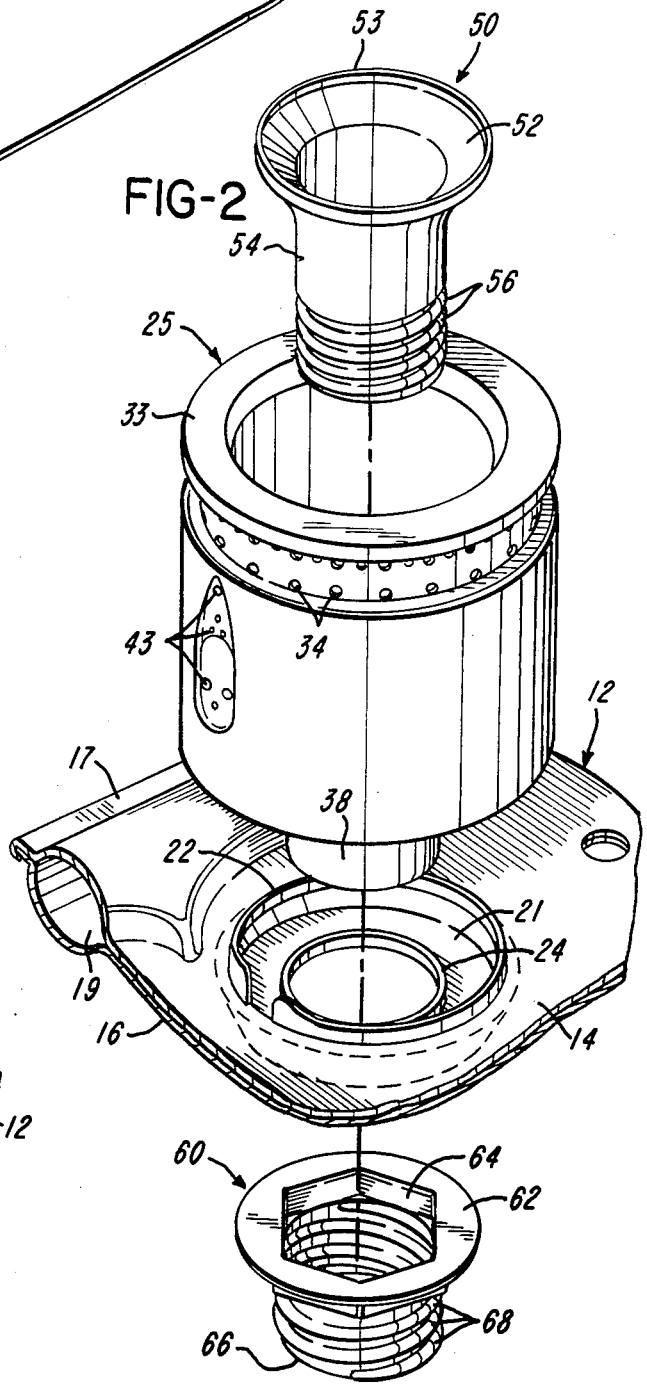
FIG. 2 is an exploded perspective view of a portion of the components forming the assembly shown in FIG. 1.

As also shown in FIGS. 2 and 3, the lower end section of the fitting 50 receives a sheet metal nut member 60 which is also drawn in progressive steps from a flat circular disk of aluminum sheet metal. The nut member 60 includes a flat upper circular flange portion 62 which is positioned to engage the bottom wall 16 of the manifold 12. A polyagonal or hexagonal portion 64 projects downwardly from the flange portion 62 and is adapted to receive a suitable wrench for tightening the nut member 60 onto the fitting 50. A tubular portion 66 projects downwardly from the hexagonal portion 64 and has a corrugated wall configuration in axial cross-section to define helical candelabra threads 68 which mate with the corresponding threads 56 on the fitting 50.

After each burner unit 25 is positioned on the manifold 12 with the openings or holes 43 aligned with the corresponding pilot tube 44, the fitting 50 is inserted into the burner unit 25 until the flange portion 52 engages the shoulder 41 within the burner unit. When the nut member 60 is threaded onto the fitting 50 and tightened, the burner unit 25 is positively secured to the manifold 12. As a result of the candelabra threads on the fitting 50 and on the nut member 60, the nut member 60 may be quickly threaded onto the fitting without any problem of cross-threading.

While the form of gas burner assembly herein described constitutes a preferred embodiment of the invention, it is to be understood that the invention is not limited to this precise form of assembly, and that changes may be made therein without departing from the scope and spirit of the invention as defined in the appended claims.

The invention having thus been described, the following is claimed:

1. In a gas burner assembly including a manifold having upper and lower sheet metal walls joined together to define a gas supply passage extending to an annular chamber, said upper and lower walls having means defining corresponding upper and lower openings for said chamber, a gas burner unit mounted on said manifold and having concentric inner and outer sheet metal walls defining an annular chamber, said outer wall of said burner unit being seated on said upper wall of said manifold around said upper opening in said upper wall, said inner wall of said burner unit including an annular shoulder and a reduced tubular section projecting downwardly from said shoulder into said lower opening in said lower wall of said manifold for connecting said annular chamber within said manifold to said annular chamber within said burner unit, the improvement comprising a drawn sheet metal fitting including a flange portion projecting outwardly from a tubular portion, said flange portion seated on said annular shoulder, said tubular portion having a corrugated wall configuration in axial cross-section and defining helical threads, said tubular portion projecting downwardly from said flange portion within said tubular section of said inner wall of said burning unit, said tubular portion projecting through said lower opening within said bottom wall of said manifold, a drawn sheet metal nut member mounted on said fitting and including a polygonal portion extending downwardly from an outwardly projecting flange portion engaging said bottom wall of said manifold, and said nut member further including a tubular portion projecting downwardly from said polygonal portion and having a corrugated wall configuration in axial cross-section to form helical threads mating with said threads on said fitting for quickly and positively securing said burner unit to said manifold.

2. A gas burner assembly as defined in claim 1 wherein said fitting and said nut member have a common center axis, and the axial length of said nut member is generally equal to the axial length of said threads on said tubular portion of said fitting.

3. A gas burner assembly as defined in claim 1 wherein said threads on said fitting and on said nut member have a pitch of about eight threads per inch.

4. A gas burner as defined in claim 1 wherein said sheet metal fitting and nut member each has a sheet metal thickness of about 0.020 inch.

5. A gas burner assembly as defined in claim 1 wherein said sheet metal fitting and nut member each comprises an aluminum sheet having a thickness of about 0.020 inch.

* * * * *